United States Patent [19]

Kohri et al.

[11] 4,426,433

[45] Jan. 17, 1984

[54] ELECTROPHOTOGRAPHIC DEVELOPER COMPOSITION OF IMPROVED RESISTANCE TO POTENTIAL DECAY

[75] Inventors: Toshitaro Kohri, Higashi Osaka; Hitoshi Kato, Itami; Noboru Ito, Kawanishi, all of Japan

[73] Assignee: Minolta Camera Kabushiki Kaisha, Japan

[21] Appl. No.: 281,205

[22] Filed: Jul. 6, 1981

[30] Foreign Application Priority Data

Aug. 23, 1980 [JP] Japan ..... 55-116146

[51] Int. Cl.[3] ..... G03C 9/10

[52] U.S. Cl. ..... 430/109; 430/110

[58] Field of Search ..... 430/122, 904, 108, 109, 430/110

[56] References Cited

U.S. PATENT DOCUMENTS

| | | | |
|---|---|---|---|
| 3,985,664 | 10/1976 | Sakaguchi et al. | 430/904 |
| 4,076,893 | 2/1978 | Gibson et al. | 430/904 |
| 4,165,393 | 8/1979 | Suzuki et al. | 430/122 |

FOREIGN PATENT DOCUMENTS 2847768 10/1979 Fed. Rep. of Germany .

*Primary Examiner*—Roland E. Martin, Jr.
*Assistant Examiner*—John L. Goodrow
*Attorney, Agent, or Firm*—Wenderoth, Lind & Ponack

[57] ABSTRACT

A developer for use in developing an electrostatic latent image according to electrography comprises a mixture of a carrier and a toner having a property of being triboelectrically charged to a positive polarity when held in frictional contact with the carrier. The toner includes a binders which is a thermoplastic resin having a Lewis acid-functional group.

4 Claims, No Drawings

ELECTROPHOTOGRAPHIC DEVELOPER COMPOSITION OF IMPROVED RESISTANCE TO POTENTIAL DECAY

BACKGROUND OF THE INVENTION

The present invention generally relates to a developer for use in an electrophotographic machine for developing an electrostatic latent image into a visible image and, more particularly, to an electrographic developer comprising a mixture of a carrier with a toner of the type having a property of being triboelectrically charged to a positive polarity when subjected to frictional contact with the carrier.

The electrophotographic developers now being produced are generally available in two types, a mono-component type and a two-component type. The two-component type developer is more widely used than the mono-component type and includes one which comprises a mass of carrier particles of relatively large particle size (within the range of 80 to 200 μm), for example, iron powder or glass beads, and a mass of fine particles, i.e., so-called "toner" particles essentially consisting of a binder and dispersed in the binder, and one wherein the carrier particles essentially consist of a binder and a powder of magnetizable material dispersed in the binder and have an average particle size within the range of 5 to 30 μm, the second-mentioned two-comonent type developer being an improved version of the first-mentioned developer, which has been developed for the purpose of substantially eliminating some problems inherent in the latter.

In the conventional two-component type developer when the carrier and toner particles are mixed together, they are triboelectrically charged to opposite polarities, the amount of triboelectrical charge on each of the carrier and toner particles being determined by the difference in level between triboelectrical charging series. Although the larger difference in level results in the increased amount of triboelectrical charge, any triboelectrical charge will be no longer generated when the difference in level is made extremely small or when the level of the triboelectrical charging series of the carrier particles and that of the toner particles are made identical with each other.

Adjustment of the amount of triboelectrical charge can in theory be accomplished by suitably selecting the material of either the carrier or the toner relative to the other. However, in practice, since the material of the carrier utilizable in a particular application is determined by the type of developing system, i.e., a cascade developing system or a magnetic brush developing system or any other developing system, the adjustment of the amount of triboelectrical charge is generally carried out by selecting the material of the toner to be mixed with the carrier. The amount of triboelectrical charge generated in the toner is determined mainly by the material for either the carrier or toner. That is to say, it is generally considered that the amount of triboelectrical charge on the toner is high for a large distance between the position of the toner material on the triboelectrical charging series and the position of the carrier material on the triboelectrical charging series. In view of this, in order to realize a difference between the position of the toner material on the triboelectrical charging series and that of the carrier material on the triboelectrical charging series, it has been a practice in the art to add a charge controller to the toner, to adjust the content of carbon black which also serves as a pigment, to change the kind of a resin and/or the kind of a monomer of a copolymeric resin, and/or to blend different kind of resins.

With respect to the polarity of triboelectrical charge, the toner can be imparted with a property of being charged to a positive polarity when an electron donor substance operable to expel electrons is added thereto, or with a property of being charged to a negative polarity when an electron acceptance substance operable to attract electrons is added thereto. The polarity of triboelectrical charge on the toner is affected also by the kind of the resin used, and it has long been well known that a styrene resin tends to exhibit the property of being charged to a negative polarity and that a resin containing nitrogen in its molecule tends to exhibit the property of being charged to a positive polarity.

Bearing the above in mind, where the electron donor substance is added to the toner of a composition containing a styrene resin so that the toner can be imparted with the property of being triboelectrically charged to a positive polarity, the triboelectrical property of the toner lacks stability and the resultant toner tends to fail to retain the initially charged positive potential for a prolonged period of time since the triboelectrical property of the electron donor substance is in opposition to that of the styrene resin. In addition, there is another case in which the toner tends to fail to retain the initially charged potential for a prolonged period of time. By way of example, when a developer which is prepared by mixing the toner with the carrier and then the toner is triboelectrified by frictional contact with the carrier and is allowed to stand for a prolonged period of time, the potential initially charged on the toner during the preparation of the developer attenuates or decays exponentially, although the rate of attenuation or decay varies depending on the conditions under which the developer is stored or shelved. The higher the temperature and/or humidity, the faster the potential decay. Conversely, the lower the temperature and/or humidity, the slower the potential decay.

However, in practice, the problem associated with the decay of the initially charged potential can be negligible except for the case with the developer of a type wherein the potential initially charged on the toner tends to attenuate extraordinarily rapidly. This is because the developer, when in use in an electrophotographic copying machine, is stirred within a developer tank or hopper and, therefore, even though the potential on the toner decays to a certain extent (the maximum possible half-life (Y value) of the potential on the toner used in the currently commercially available developer mix of this kind is about one week.) while the machine is not in operation, the toner can again be charged in frictional contact with the carrier during the stirring that takes place within the developer tank or hopper. However, not only because the developer is in most cases exposed to numerous environmental conditions during a period subsequent to the preparation thereof until it is charged into the machine or it is replaced with the one being used, but also because it will take a relatively long period of time subsequent to the preparation thereof and before it is actually used in the machine, there are some problems associated with the decay of the initially charged potential on the toner, which problems cannot be resolved merely by stirring the developer within the developer tank or hopper during the developing process being performed by the machine.

By way of example, where the development of the electrostatic latent image into a visible image is carried out by the use of the developer containing the toner, the initially charged potential of which has decayed during the storage of such developer, the use of such developer brings about some adverse influences on the resultant visible image, for example, the excessively high density, the undesirably foggy background of the developed image, the undesirable scattering of toner particles which would take place during transportation of particles of the developer on a developing sleeve in the machine.

In view of the above, it has long been desired to manufacture a toner such that the potential initially charged thereon can be retained for a prolonged period of time as occurs before the shipment from its manufacturer and with the minimized attenuation thereof, even when exposed to such numerous environmental conditions as they may occur.

SUMMARY OF THE INVENTION

The present invention has been developed with a view to substantially eliminating the above described disadvantages and inconveniences and has for its essential object to provide an improved developer for use in electrographic image development, which developer contains a toner of a type capable of exhibiting a minimized rate of potential decay.

According to the present invention, the above described and other objects can be accomplished by utilizing the toner of a unique composition comprising a coloring agent, a charge controller capable of imparting to the toner a property of being triboelectrically charged to a positive polarity when the toner is subjected to frictional contact with the carrier, and a binder. At least a portion of the binder used therein consists essentially of a thermoplastic resin having a Lewis acid-functional group.

The charge controller which serves to impart to the toner the property of being triboelectrically charged to a positive polarity when the toner is subjected to frictional contact with the carrier (which property is hereinafter and in the appended claims referred to as a "tribo-positive chargeable property") may be employed in the form of an oil black of nigrosine or a pigment having an ionic center which becomes positive when liberated. Specifically, examples of the nigrosine oil black includes those commercially manufactured and sold under trade names "Special Black EB", "Oil Black BY", "Oil Black BS", and "Nigrosine Base EX" all from Orient Chemical Industries Co., Ltd. of Japan, whereas examples of the pigment referred to above include a basic pigment (Crystal Violet, Victria Blue or Methyl Violet) of triphenyl methane. It is to be noted that the amount of the charge controller contained in the toner in the developer of the present invention must be so selected as to generate positive ions in the toner in an amount sufficient or higher to neutralize negative ions generated in the presence of a Lewis acid-functional group as discussed below.

The Lewis acid-functional group is a functional group capable of attracting electron pairs and includes, for example, a carboxylic group, a carbonyl group, a nitro group, a cyano group, a glycidyl group, and a nitrile group. Examples of the thermoplastic resin having this Lewis acid-functional group include, in addition to epoxy resin, a mono-functional group include, in addition to epoxy resin, a mono-functional methacrylic monomer, a copolymer of a monomer, such as acrylic acid, maleic acid or itaconic acid, with one or a combination of non-functional methacrylic monomers, and a copolymer of styrene with said copolymer. Although the mono-functional methacrylic monomer includes methacrylic acid, glycidyl methacrylate and 2-hydroxyethyl methacrylate, it need not be limited thereto.

The non-functional methacrylic monomers includes methyl methacrylate, ethyl methacrylate, propyl methacrylate, butyl methacrylate, 2-ethylhexyl methacrylate, and isobutyl methacrylate, but it may not be limited thereto.

Though the above described thermoplastic resin having the Lewis acid-functional group generates negative ion because the Lewis acid-functional group serves to attract the electron pairs, this thermoplastic resin, when it coexists with the charge controller having a higher tribo-positive chargeable property in the toner, exhibits a tribo-positive chargeable property. In addition, negative ions attributable to the Lewis acid-functional group and positive ions of the charge controller attract each other, when both the thermoplastic resin and the charge controller are in coexistence, so that the positive ions can be stabilized and, therefore, even when the activation energy becomes high under the influence of heat, not only can the toner exhibit a more stable tribo-positive chargeable property, but also it involves a minimized rate of potential decay.

The binder used in the present invention may be the above described thermoplastic resin having the Lewis acid-functional group or a blend of dissimilar thermoplastic resins each having the Lewis acid-functional group, or a mixture of the thermoplastic resin having the Lewis acid-functional group with a thermoplastic resin having no Lewis acid-functional group. In either case, where the Lewis acid-functional group is a carboxylic group, the thermoplastic resin having the carboxylic group is preferred to have an acid value within the range of 3 to 200 mg.KOH/g. If the acid value is smaller than the lower limit of 3 mg.KOH/g, the thermoplastic resin brings about no effect and if it larger than the upper limit of 200 mg.KOH/g, not only is difficulty involved in synthesis of the thermoplastic resin, but also the resultant toner tends to be imparted with a tribo-negative chargeable property, i.e., a property of being triboelectrically charged to a negative polarity when subjected to frictional contact with the carrier, and, therefore, the stability of the toner having the tribo-positive chargeable property may be impaired. It is to be noted that the term "acid value" stands for the amount, in terms of mg. of KOH required to neutralize the carboxylic group in 100 g of the thermoplastic resin and is substantially indicative of the amount of the carboxylic group contained in the resin.

Where the Lewis acid-functional is a glycidyl group, it is preferred that the epoxy value be within the range of 300 to 20,000 with the number average molecular weight being within the range of 6,000 to 60,000. This is because, if the epoxy value is smaller than the lower limit of 300, the molecular weight is so small that the resultant toner may exhibit an inferior shelf stability. In addition, the smaller epoxy value results in the relatively increased amount of the glycidyl group per molecule such that the glycidyl group may rupture to result in partial three dimensional bridging under the influence of heat during kneading, which is performed by the application of heat during the manufacture, to such an extent as to bring about gelation with increased viscosity, and, therefore, not only is difficulty involved in its manufacture, but also the fixing capability of the toner itself may be adversely affected. If the epoxy value is larger than the upper limit of 20,000, the number of the glycidyl groups per molecule is so small as to bring about no substantial effect. It is to be noted that the term "epoxy value" stands for the number average molecular weight (Mn) divided by the number of the glycidyl groups contained in the average one molecule, which number average molecular weight is measured by the gel permeation chromatography (GPC).

DETAILED DESCRIPTION OF THE EMBODIMENT

The present invention will now be described by way of non-limitative, but illustrative examples.

EXAMPLE 1

100 parts by weight of tetrahydrofuran filled in a four-necked flask equipped with a cooling coil was heated under reflux in a stream of nitrogen. While the tetrahydrofuran is so heated, 100 parts by weight of styrene, 73 parts by weight of butyl methacrylate, 16 parts by weight of 2-ethylhexyl methacrylate, 4 parts by weight of methacrylate and 5 parts by weight of azo-bis-isobutyronitrile were dropped into the flask over 3 hours and these mixture were stirred for 5 hours. Thereafter, the solvent was removed by evaporation, leaving in the flask a solid copolymer having the Lewis acid-functional group. The acid value of the copolymer so obtained was 14 mg.KOH/g, the molecular weight thereof being 20,000 in terms of the number average molecular weight (Mn) and 44,000 in terms of the weight averge molecular weight (Mn).

Subsequently, 100 parts by weight of the copolymer so obtained was mixed with 5 parts by weight of carbon black (manufactured and sold under the trade name "MA #100" from Mitsubishi Chemical Industries Ltd. of Japan) and 2 parts by weight of oil black (manufactured and sold under the trade name "Oil Black BS" from Orient Chemical Industries Co., Ltd. of Japan), and the resultant mixture was, after having been kneaded in the conventional manner, pulverized and then classified to give particles of a toner having a tribo-positive chargeable property, the average particle size of which was 12 μm.

The number average molecular weight referred to above was measured according to the gel permeation chromatography and was calculated from a correction curve representative of that of a standard polystyrene.

EXAMPLE 2

With the use of a composition containing 100 parts by weight of styrene, 28 parts by weight of methacrylate, 16 parts by weight of methyl methacrylate, 11 parts by weight of butyl methacrylate, 16 parts by weight of 2-ethylhexyl methacrylate and 1.6 parts by weight of azo-bis-isobutyronitrile, a copolymer having the Lewis acid-functional group was prepared in the same manner as in Example 1.

The acid value, the number average molecular weight and the weight average molecular weight of the copolymer so obtained were 105 mg.KOH/g, 18,000 and 45,000, respectively.

Subsequently, 100 parts by weight of this copolymer was mixed with 4 parts by weight of carbon black (manufactured and sold under the trade name "#44" from Mitsubishi Chemical Industries Ltd.) and 8 parts by weight of oil black (manufactured and sold under the trade name "Oil Black BY" from Orient Chemical Industries Co., Ltd.) and the resultant mixture was, after having been kneaded, pulverized and then classified to give a toner having a tribo-positive chargeable property, the average particle size of which was 13 μm.

EXAMPLE 3

With the use of 100 parts by weight of styrene, 39 parts by weight of butyl methacrylate, 32 parts by weight of methacrylate and 3.4 parts by weight of azo-bis-isobutyronitrile, a copolymer was prepared by the same manner as in Example 1.

The acid value, the number average molecular weight and the weight average molecular weight of the copolymer so obtained were 120 mg.KOH/g, 11,000 and 25,000, respectively.

Subsequently, the copolymer was blended with an equal amount of a homopolar styrene-acrylic copolymer (manufactured and sold under the trade name "Himer SBM-73" from Sanyo Chemical Industries Ltd. of Japan), and 100 parts by weight of the blended mixture was mixed with 3 parts by weight of carbon black (manufactured and sold under the trade name "MA #100" from Mitsubishi Chemical Industries Ltd.) and 7 parts by weight of oil black (manufactured and sold under the trade name "Special Black EB" from Orient Chemical Industries Co., Ltd.). The resultant mixture was, after having been kneaded, pulverized and then classified to give a toner having the tribo-positive chargeable property, the average particle size of which was 14 μm.

EXAMPLE 4

With the use of a composition containing 100 parts by weight of styrene, 17 parts by weight of methyl methacrylate, 48 parts by weight of butyl methacrylate, 30 parts by weight of 2-ethylhexyl methacrylate, 2 parts by weight of glycidyl methacrylate and 5 parts by weight of azo-bis-isobutyronitrile, a copolymer was prepared in the same manner as in Example 1.

The number average molecular weight and the weight average molecular weight of the copolymer so obtained were 25,000 and 51,000, respectively, whereas the epoxy value was within the range of 11,000 to 12,000.

Subsequently, 100 parts by weight of this copolymer was mixed with 5 parts by weight of carbon black (manufactured and sold under the trade name "MA #100" from Mitsubishi Chemical Industries Ltd.) and 2 parts by weight of oil black (manufactured and sold under the trade name "Oil Black BS" from Orient Chemical Industries Co., Ltd.) and the resultant mixture was, after havng been kneaded, pulverized and then classified to give a toner having a tribo-positive chargeable property, the average particle size of which was 13 μm.

EXAMPLE 5

With the use of 100 parts by weight of styrene, 72 parts by weight of butyl methacrylate, 22 parts by weight of glycidyl methacrylate and 2 parts by weight of azo-bis-isobutyronitrile, a copolymer having the Lewis acid-functional group was prepared in the same manner as in Example 1.

The number average molecular weight and the weight average molecular weight were 35,000 and 77,000 respectively while the epoxy value was within the range of 1200 to 1300.

Subsequently, 100 parts by weight of the copolymer was mixed with 3 parts by weight of carbon black (manufactured and sold under the trade name "MA #8" from Mitsubishi Chemical Industries Ltd.) and 3 parts by weight of oil black (manufactured and sold under the trade name "Oil Black BS" from Orient Chemical Industries Co., Ltd.), and the resultant mixture was, after, having been kneaded, pulverized and then classified to give a toner having a tribo-positive chargeable property, the average particle size of which was 12 μm.

EXAMPLE 6

With the use of a composition containing 100 parts by weight of styrene, 40 parts by weight of methyl methacrylate, 40 parts by weight of 2-ethylhexyl methacrylate, 52 parts by weight of glycidyl methacrylate and 6.6 parts by weight of azo-bis-isobutyronitrile, a copolymer having the Lewis acid-functional group was prepared in the same manner as in Example 1.

The number average molecular weight and the weight average molecular weight of the copolymer so obtained were 18,000 and 85,000 respectively, whereas the epoxy value was within the range of 500 to 600.

Subsequently, the copolymer was blended with an equal amount of a homopolar styrene-acrylic copolymer (manufactured and sold under the trade name "Himer SBM-73" from Sanyo Chemical Industries Ltd. of Japan), and 100 parts by weight of the blended mixture was mixed with 7 parts by weight of carbon black (manufactured and sold under the trade name "MA #100" from Mitsubishi Chemical Industries Ltd.) and 7 parts by weight of oil black (manufactured and sold under the trade name "Oil Black BY" from Orient Chemical Industries Co., Ltd.). The resultant mixture was, after having been kneaded, pulverized and then classified to give a toner having a tribo-positive chargeable property, the average particle size of whch was 13 μm.

Comparison 1

With the use of the same composition as in Example 1 except that the methacrylate was omitted, a copolymer, 19,000 and 43000 in number and weight average molecular weight, respectively, was prepared in the same manner as in Example 1 and was subsequently processed in the same manner as in Example 1 to give a toner, 12 μm in average particle size.

Comparison 2

With the use of the same composition as in Example 2 except that the methacrylate was omitted, a copolymer, 20,000 and 46,000 in number and weight average molecular weight respectively, was prepared in the same manner as in Example 1 and was subsequently mixed and pulverized in the same manner as in Example 2 to give a toner, 13.5 μm in average particle size.

Comparison 3

100 parts by weight of homopolar styrene-acryl copolymer, 3 parts by weight of carbon black ("MA #100") and 3 parts by weight of oil black (manufactured and sold under the trade name "Special Black ES" from Orient Chemical Industries Co., Ltd.) were mixed and processed in the same manner as in Example 3 to give a toner, 13.5 μm in average particle size.

Comparison 4

With the use of the same composition as in Example 4 except that the glycidyl methacrylate was omitted, a copolymer, 22,000 and 48,000 in number and weight average molecular weight, respectively, was prepared in the same manner as in Example 1 and was subsequently processed in the same manner as in Example 4 to give a toner, 12 μm in average particle size.

Comparison 5

With the use of the same composition as in Example 5 except that the glycidyl methacrylate was omitted, a copolymer, 32,000 and 70,000 in number and weight average molecular weight, respectively, was prepared in the same manner as in Example 1 and was subsequently processed in the same manner as in Example 5 to give a toner, 13 μm average particle size.

Comparison 6

With the use of the same composition as in Example 6 except that the glycidyl methacrylate was omitted, a copolymer, 15,000 and 29,000 in number and weight average molecular weight, respectively, was prepared in the same manner as in Example 1. This copolymer was blended with an equal amount of the styrene-acryl copolymer "Himer SBM-73" to give a toner, 14 μm in average particle size.

Comparison 7

After 100 parts by weight of the styrene-acryl copolymer "Himer SBM-73" has been mixed and kneaded with 5 parts by weight of the oil black "Oil Black SN-4" (the trade name used by Orient Chemical Industries Co., Ltd. This is a base of stearic acid and oil black.) and 4 parts by weight of the carbon black "MA #100", the mixture was pulverized and then classified to give a toner having a tribo-positive chargeable property, the average particle size of which was 12 μm.

In order to find the potential retention of the toner according to each of the above described examples and comparisons, the toner was mixed in a mixing ratio of 10:100 with a micro carrier of the following composition, 21 μm in average particle size, which was prepared in the conventional manner. The resultant mixture of the toner according to any one of the above examples and comparisons with the micro carrier of the following composition was subsequently stirred to allow the toner become triboelectrically charged and was filled in a poyethylene bottle which was thereafter tightly sealed to avoid any possible intrusion of humidity. The respective bottle was stored at 35° C. for a respective period of time specified in the following Table 1 to determine the time-dependent change of the potential charged on the respective toner.

The results of the experiments conducted in the manner described above are shown in Table 1.

| Composition of Micro Carrier: | |
|---|---|
| Pliolite ACL ® (Styrene-acryl Copolymer manufactured and sold by Good Year Chemicals of USA) | 100 wt parts |
| Tri-iron tetroxide ("Mapico Black BL500" manufactured and sold by Titan Kogyo Co., Ltd. | 200 wt parts |
| Carbon black ("MA #100") | 5 wt parts |

Similar experiments to that described above, but using a carrier composed of 100 parts by weight of powdery iron particles (manufactured and sold under a trade name "TEF-V" by Nippon Iron Powder Co., Ltd. of Japan) and 5 parts by weight of the toner according to each of the above examples and comparisons were conducted, the results of which are also shown in Table 1.

From Table 1 above, it is clear that, irrespective of the type of carrier used, the toner according to the present invention exhibits a lower rate of the potential decay against time than that exhibited by the toner according to any one of the comparisons and that about 70 to 90% of the initially charged potential was retained by the toner according to any one of the examples even after one month had passed. It is to be noted that the toner prepared by mixing the thermoplastic resin having no Lewis acid-functional group with the stearic acid having the Lewis acid-functional group, such as in Comparison 7, has exhibited no improvement in potential retention and is inferior to the toner used in the developer of the present invention.

TABLE 1

| TYPE OF CARRIER | Type of Toner | Immediately after Stirring | One Day Later | One Week Later | One Month Later |
|---|---|---|---|---|---|
| Micro Carrier | Example 1 | 18 μc/g | 12 μc/g | 11 μc/g | 10 μc/g |
| | Example 2 | 14 | 13 | 13 | 11 |
| | Example 3 | 16 | 15 | 12 | 12 |
| | Example 4 | 12 | 11 | 10 | 8.5 |
| | Example 5 | 15 | 14 | 12 | 11 |
| | Example 6 | 10 | 9 | 8 | 7.5 |
| | Comp. 1 | 14 | 11 | 8 | 5 |
| | Comp. 2 | 16 | 12 | 9 | 6 |
| | Comp. 3 | 17 | 14 | 9 | 7 |
| | Comp. 4 | 12 | 10 | 7 | 4 |
| | Comp. 5 | 14 | 11.5 | 9 | 5.5 |
| | Comp. 6 | 10 | 7.5 | 6 | 3 |
| | Comp. 7 | 15 | 12 | 10 | 8 |
| Powdery Iron Carrier | Example 1 | 6 | 5 | 4 | 4 |
| | Example 2 | 8 | 6 | 5 | 5 |
| | Example 3 | 9 | 7 | 6 | 5 |
| | Example 4 | 7 | 6 | 5 | 4.5 |
| | Example 5 | 9 | 8 | 7 | 6 |
| | Example 6 | 6 | 5 | 4.5 | 4 |
| | Comp. 1 | 6 | 4 | 3 | 1 |
| | Comp. 2 | 7 | 4 | 3 | 2 |
| | Comp. 3 | 10 | 7 | 5 | 3 |
| | Comp. 4 | 8 | 6 | 4 | 2.5 |
| | Comp. 5 | 10 | 8 | 6.5 | 3.5 |
| | Comp. 6 | 7 | 5 | 4 | 2.5 |
| | Comp. 7 | 8 | 5 | 4 | 3 |

When each developer, having been stored for one month for the purpose of the above described experiments, was then used in practice in the electrophotographic copying machine having a magnetic brush development system and an electrostatic latent image formed on a photosensitive medium by a known electrophotographic process was subsequently developed, it was found that the developer of the present invention posed no problem while the developer containing the toner according to any one of Comparisons 1 to 7 showed both a scattering of a large amount of toner particles and a foggy reproduction of the image, as shown in Tables 2 and 3.

TABLE 2

| Type of Carrier | Type of Toner | Amount Scattered |
|---|---|---|
| Micro Carrier | Example 1 | 0.4 mg/m$^3$ |
| | Example 2 | 0.2 |
| | Comp. 1 | 82 |
| | Comp. 2 | 66 |

TABLE 3

| Type of Carrier | Type of Toner | Reproduced Image: Shortly after start of Development | Reproduced Image: After Reproduction on 5000 A-4 size copy Papers |
|---|---|---|---|
| | Example 1 | Excellent | Good |
| | Comp. 1 | Fair | Worse |
| | Comp. 2 | Fair | Bad |
| | Comp. 3 | Good | Fair |
| | Comp. 4 | Bad | Worst |
| | Comp. 5 | Fair | Worse |
| | Comp. 6 | Worse | Worst |
| | Comp. 7 | Good | Fair |

With respect to Table 2, the amount of toner particles scattered was measured by the use of a dust meter, model P-2, manufactured and sold by Shibata Chemical Instrument Co., Ltd. while the magnetic brush development system used was of a construction shown in FIG. 2 of the pending U.S. patent application Ser. No. 134,131, filed Mar. 26, 1980 and assigned to the same assignee of the present invention. The measurement was carried out while the dust meter was installed externally of and adjacent the magnetic brush developer unit and the developing sleeve and the magnet roller were rotated in the same direction for one minute.

With respect to Table 3, the developers used were the ones as prepared. Consecutive reproduction of the same image on 5000 copy papers of A-4 size was carried out at a rate of 12 copy papers per minute.

Although the present invention has fully been described by way of the examples, it is to be noted that various changes and modifications are apparent to those skilled in the art. Such changes and modifications are to be understood as included within the scope of the present invention unless they depart therefrom.

We claim:

1. A developer for use in developing an electrostatic latent image by electrophotography, which developer comprises a carrier and a toner, said developer being of improved resistance to potential decay and said toner comprising a coloring agent, a charge controller capable of imparting tribopositive chargeability to the toner and a binder, at least a portion of said binder being a thermoplastic resin having a functional group consisting essentially of a Lewis acid functional group, and said resin being tribonegatively chargeable, the charge controller being present in an amount sufficient to impart tribopositive chargeability to the toner.

2. The developer as claimed in claim 1, wherein said Lewis acid-functional group is selected from the group consisting of carboxylic group, carbonyl group, nitro group, cyano group and glycidyl group.

3. The developer as claimed in claim 1, wherein said Lewis acid-functional group is a carboxyl group and said thermoplastic resin has an acid value within the range of 3 to 200 mg.KOH/g.

4. The developer as claimed in claim 1, wherein said Lewis acid-functional group is a glycidyl group and said thermoplastic resin has an epoxy equivalent within the range of 300 to 20,000, the number average molecular weight of said resin being within the range of 6,000 to 60,000.

* * * * *